United States Patent [19]

Hays et al.

[11] 4,336,693

[45] Jun. 29, 1982

[54] REFRIGERATION PROCESS USING TWO-PHASE TURBINE

[75] Inventors: Lance G. Hays, Los Angeles; Walter R. Studhalter, Woodland Hills; Emil W. Ritzi, Manhattan Beach, all of Calif.

[73] Assignee: Research-Cottrell Technologies Inc., Santa Monica, Calif.

[21] Appl. No.: 145,470

[22] Filed: May 1, 1980

[51] Int. Cl.[3] ..... F25B 1/00

[52] U.S. Cl. ..... 62/116; 60/651; 60/671

[58] Field of Search ..... 62/116, 500, 499; 60/651, 671

[56] References Cited

U.S. PATENT DOCUMENTS

| | | | |
|---|---|---|---|
| 2,488,157 | 11/1949 | Bassano | 62/500 |
| 2,519,010 | 8/1950 | Zearfoss, Jr. | 62/116 |
| 3,300,995 | 1/1967 | McGrath | 62/500 |
| 3,808,828 | 5/1974 | Kantor | 62/116 |
| 3,879,949 | 4/1975 | Hays et al. | 60/649 |
| 3,972,195 | 8/1976 | Hays et al. | 60/671 |
| 4,087,261 | 5/1978 | Hays et al. | 60/649 |
| 4,170,116 | 10/1979 | Williams | 62/116 |

*Primary Examiner*—Ronald C. Capossela
*Attorney, Agent, or Firm*—William W. Haefliger

[57] ABSTRACT

A reaction turbine is used in a refrigeration (or heat pump) process, to improve efficiency.

16 Claims, 9 Drawing Figures

COOLING
COMPRESSOR
DRIVE
NOZZLE
ROTOR
DIFF. COLLEC.
LOAD
EVAP.
HEAT
VAPOR
P1
P2
P3
109
109a
109b
110
111
112
113
114
115
115a
115b
116
116a
116b
117
117a
117b
118
118a
118b
119
119a
119b
120
120b
121
121a
121b
122
122a
122b
123
123a
123b
124
124a
124b
125
125a
125b
126
126a
126b
127
127a
128
129
135
135a

REFRIGERATION PROCESS USING TWO-PHASE TURBINE

BACKGROUND OF THE INVENTION

This invention relates generally to process refrigeration, and more particularly concerns the employment of a reaction turbine, or turbines, in such refrigeration, to improve efficiency.

A typical refrigeration system includes a compressor delivering pressurized refrigerant vapor to a condenser, a throttling valve receiving pressurized liquid refrigerant from the condenser and expanding same to produce colder liquid, and an evaporator wherein the cold liquid absorbs heat (from a body, room or fluid to be cooled) and evaporates for re-supply to the compressor. It has been proposed to replace the throttling valve (that expands the saturated refrigerant) with an expansion turbine. Extraction of shaft power will change the expansion at constant enthalpy that is characteristic for a throttling process to a nearly ideal isentropic expansion. The benefits derived by such an expansion are two-fold: the mass fraction of vapor produced as a result of the expansion is reduced when comparing the isentropic with the isenthalpic process. Secondly, power becomes available. The reduced vapor mass fraction means more liquid is available for evaporation cooling in the evaporator, and less vapor needs to be compressed.

One disadvantage of a conventional expansion turbine is the increased complexity of the machinery, which can reduce the reliability of the process. Typically, the entire two-phase refrigerant fluid mixture is run through the turbine nozzle and rotor passages. If droplets and vapor would follow the same paths (without droplet drift) the fluid could be considered pseudo-homogeneous with an average density considerably above that of the vapor. However, the concentrated masses of the droplets can be made to accelerate along curved paths only by substantial frictional drag forces exerted by the vapor, since pressure gradients are insufficient. In this regard, it is a good approximation to assume that the liquid droplets continue to move in a straight path in the initially assumed direction. Consequently, the droplets will impinge on the walls of curved nozzles and in the turbine buckets. The attending erosion and loss of efficiency make the application of a conventional expansion turbine questionable in mixtures where 90% of the mass is liquid. That conclusion is amplified when the volume ratio of the two phases is considered. Using a second stage ethylene expander as an example, the density ratio at the end of the expansion is 101.4; for a vapor mass fraction of 10% of the total mass the volume ratio of liquid to total volume becomes 1/12.3. Only 8.2% of the total volume flow is liquid. Since the turbine has to be dimensioned for handling the vapor and not only the liquid, equal velocities in both phases would spread the liquid (after impact) in a thin film over a large bucket surface. If the liquid path is long in relation to the hydraulic diameter of the liquid flow cross-section, the decline in liquid kinetic energy due to friction becomes large.

SUMMARY OF THE INVENTION

It is a major object of the invention to provide for the use of a two-phase reaction turbine in a refrigeration process, to improve the efficiency of the latter, and specifically to maximize the liquid mass fraction resulting from process fluid expansion. Such a turbine accomplishes the refrigerant expansion in a manner to minimize or eliminate the losses discussed above, and in addition produces useful power.

Fundamentally, the refrigeration system includes a flow path wherein the fluid refrigerant is compressed (as in a compressor, for example) and then cooled (as in a condenser), the system employing a reaction turbine to expand the compressed and cooled fluid to lower pressure and temperature levels. Also the system includes ducting (as in an evaporator) through which the expanded fluid passes and absorbs heat to produce refrigeration. In this environment, the reaction turbine is characterized by:

(a) the expansion means including nozzle means to receive the cooled fluid and to produce a liquid and vapor discharge, (b) and a separator rotor located in such proximity to the nozzle means as to be rotated in response to the liquid discharge toward the rotor, the rotor carrying reaction nozzle means to discharge pressurized liquid for developing torque acting to rotate the rotor, (c) at least some of the liquid discharged from said rotor reaction nozzle means flowing to the refrigeration ducting.

The reaction turbine operates to separate vapor from liquid before extracting power. The liquid fraction of the total mass that enters the rotor is specified by the liquid mass fraction at the two-phase nozzle exit. Then the reaction turbine and diffuser extract kinetic energy from the liquid. Any kinetic energy that is not extracted will create more vapor if allowed to turn into heat. That extra vapor, combined with the vapor separated after the nozzle, gives the total amount of vapor. From the total amount of vapor one determines the vapor fraction of the total mass. (That fraction is the turbine's exit quality). A non separating turbine would require an isentropic efficiency equal to the reaction turbine's effective efficiency to get the same exit quality.

The turbine rotor typically has an annular surface located in the path of the nozzle discharge for supporting a centrifugally pressurized layer of separated liquid, that layer being in communication with the reaction nozzle means (carried by the rotor). The liquid mass flow through the turbine rotor depends on the velocity of the reaction jets relative to the rotor. This velocity, and the liquid flow, decreases when the rotor speed decreases and when the thickness of the liquid ring in the rotor becomes thinner. The speed and liquid ring thickness determine the pressure field which accelerates the flow through the reaction nozzles. At a given liquid flow, the speed and liquid ring thickness will be in balance. However, when flow is decreased, the best rotor efficiency is obtained when the liquid ring thickness is maintained. Then, speed must be decreased to accommodate the reduced flow. The goal of the turbine design is to maximize the liquid mass fraction leaving the turbine.

Other objects include the provision of two or more of such turbines in stages, to increase system efficiency; and to provide for compression of vapor separated from liquid in the turbine, such compression produced by vanes carried by the turbine rotor; and the provision of a heat pump system and process employing such a turbine.

These and other objects and advantages of the invention, as well as the details of an illustrative emodiment, will be more fully understood from the following description and drawings, in which:

DRAWING DESCRIPTION

FIG. 4*a* is similar;

Figure 5:
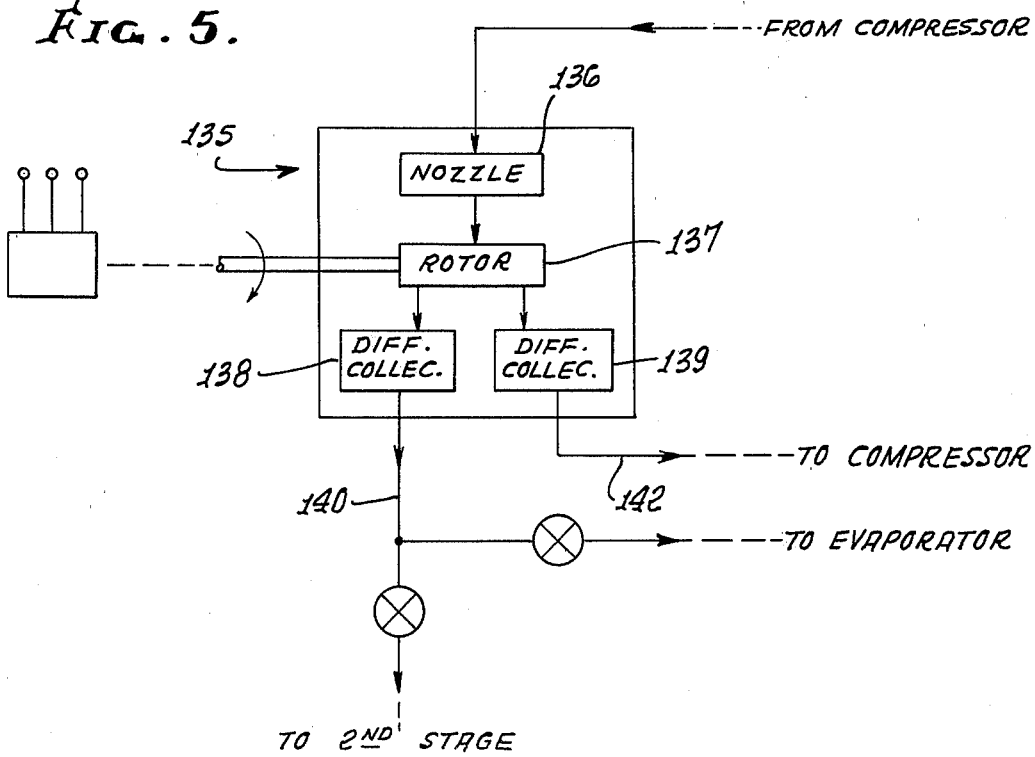
FIG. 5 is a diagram showing a modified turbine.
Figure 6:
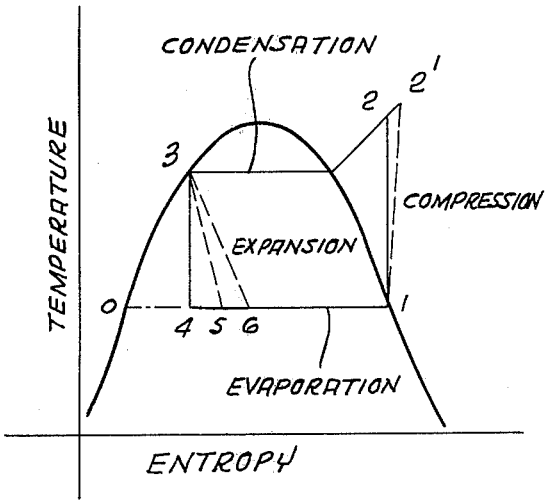
Figure 5A:
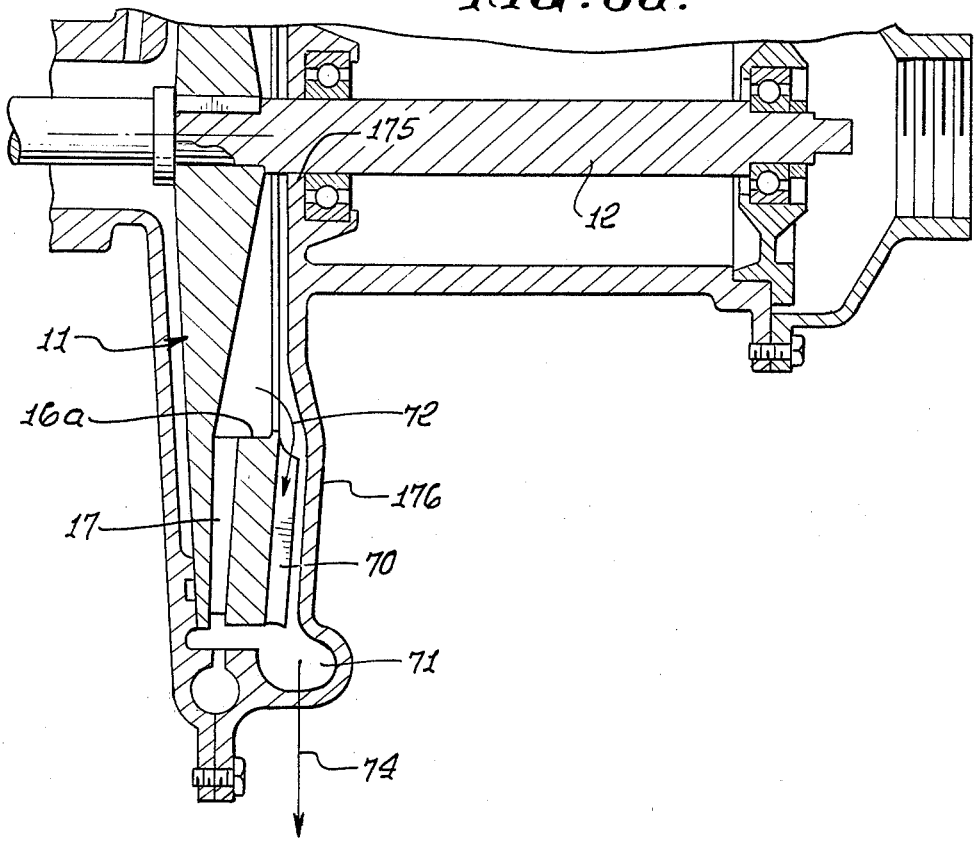

FIG. 5*a* shows a turbine construction according to FIG. 5;

FIG. 6 is a thermodynamic process diagram; and

Figure 7:
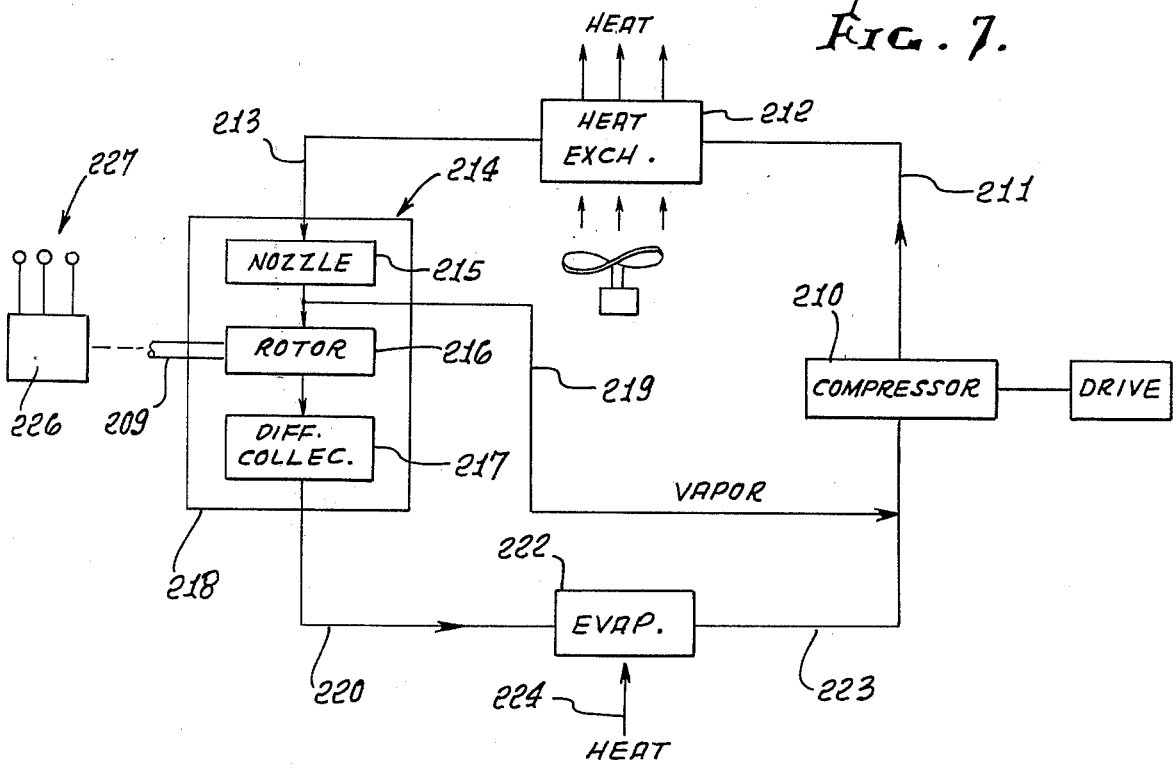

FIG. 7 is a heat pump system diagram.

DETAILED DESCRIPTION

Figure 4:
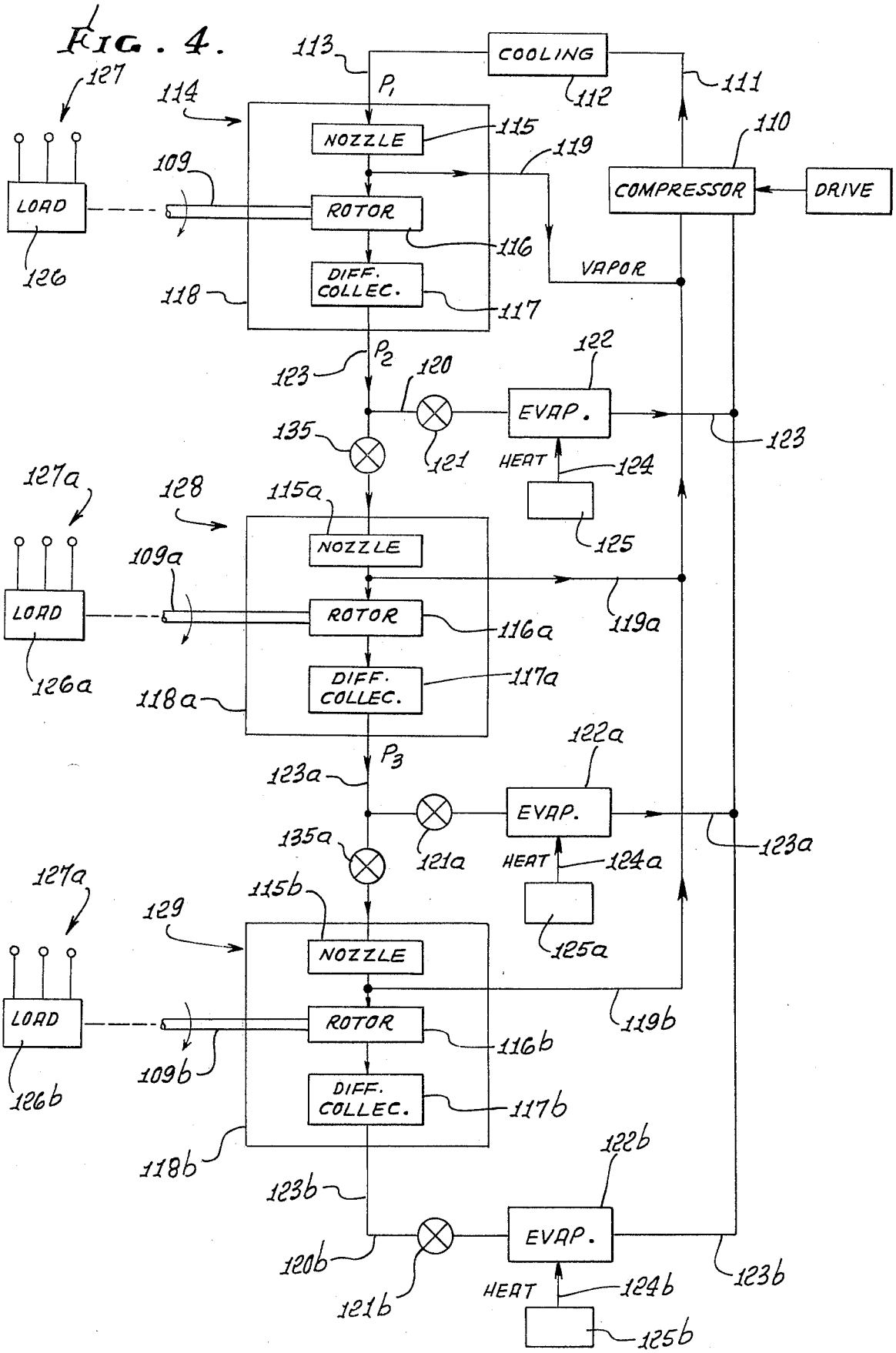
FIG. 4 is a diagram showing a refrigeration system incorporating the invention.

Referring first to FIG. 4, liquid refrigerant is compressed at 110, passed via duct 111 to heat exchanger or condenser 112 wherein it is cooled, and then passed via duct 113 to two-phase turbine 114, entering the turbine at pressure $p_1$. The turbine basically incorporates three components arranged in series: a two-phase nozzle 115, a rotor 116, and a diffuser collector 117. Since refrigerant vapor is separated from the refrigerant liquid after passage through the two-phase nozzle, principally liquid flows via the rotor to the diffuser collector. Vapor collects within housing 118, and is removed via line 119 for return to the compressor.

Refrigerant liquid leaving the turbine at reduced pressure $p_2$, is indicated at 123. Some or all of such liquid is passed at 120, as via valve 121, to evaporator 122 from which the liquid discharges at 123 for return to the compressor 110. The evaporator absorbs heat 124 to provide cooling to means 125. The turbine rotor drives a shaft 109 which in turn drives a load 126, as for example an electrical generator producing three-phase power at 127. Other loads may be driven. Also, an absorber may be substituted for the compressor 110, the latter being generic.

Second and third turbine stages may be employed, as represented by turbines 128 and 129, each like turbine 114. Thus, some of the refrigerant liquid 123 may be passed via valve 135 to turbine 128 where it is expanded through nozzle 115*a*. Liquid leaving nozzle 115*a* drives rotor 116*a* which in turn drives load 126*a* corresponding to load 126. Vapor is collected within housing 118*a* and leaves via line 119*a* for return to the compressor. Likewise, some or all of the liquid discharging from turbine 128 at pressure $p_3$ may be passed via valve 121*a* to evaporator 122*a* which provides cooling for means 125*a*. The third turbine stage 129 employs corresponding elements, as marked. Vapor leaving the evaporators 122*a* and 122*b* is returned, as shown, to the compressor. Two or more of the evaporators 122, 122*a* and 122*b* may be combined in one unit, if desired.

Figure 4A:
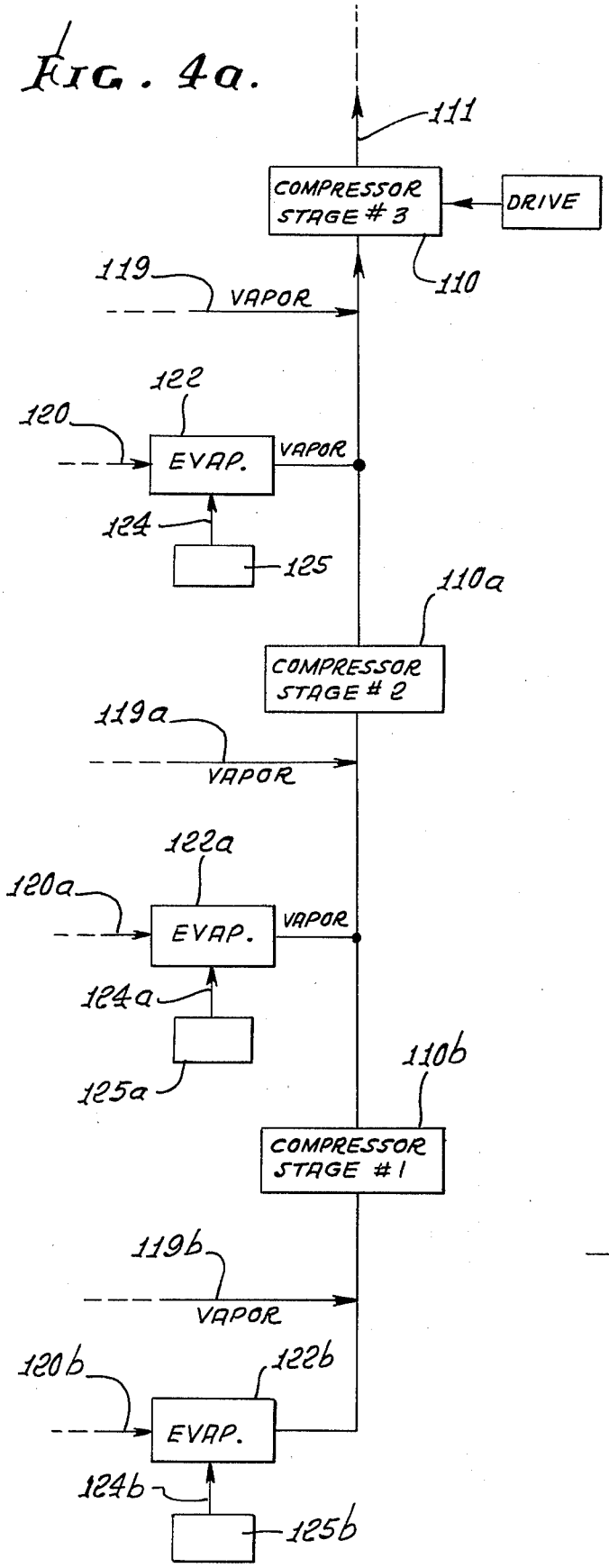

FIG. 4*a* is the same as FIG. 4 except that multiple compressor stages 110, 110*a* and 110*b* are employed, as shown.

In FIG. 5, the modified turbine 135 is like the turbine 114, except for its employment of a first diffuser-collector 138 liquid refrigerant, and a second diffuser-collector 139 for gaseous refrigerant. Thus, liquid refrigerant passes via nozzle 136 to rotor 137 wherein it separates into gas and liquid. The liquid is used to drive the rotor, as will be explained, it passes through the diffuser-collector 138, and then passes to the exterior of the turbine at 140. The latter line corresponds to line 123 in FIG. 4. The gaseous component is pressurized in and by vanes on the rotor, and it passes to the diffuser-collector 139. From the latter, the partially pressurized gaseous component is returned via path 142 to the compressor. Accordingly, process efficiency is enhanced, since the compressor requires less energy to compress the vapor delivered to the condenser.

Figure 1:
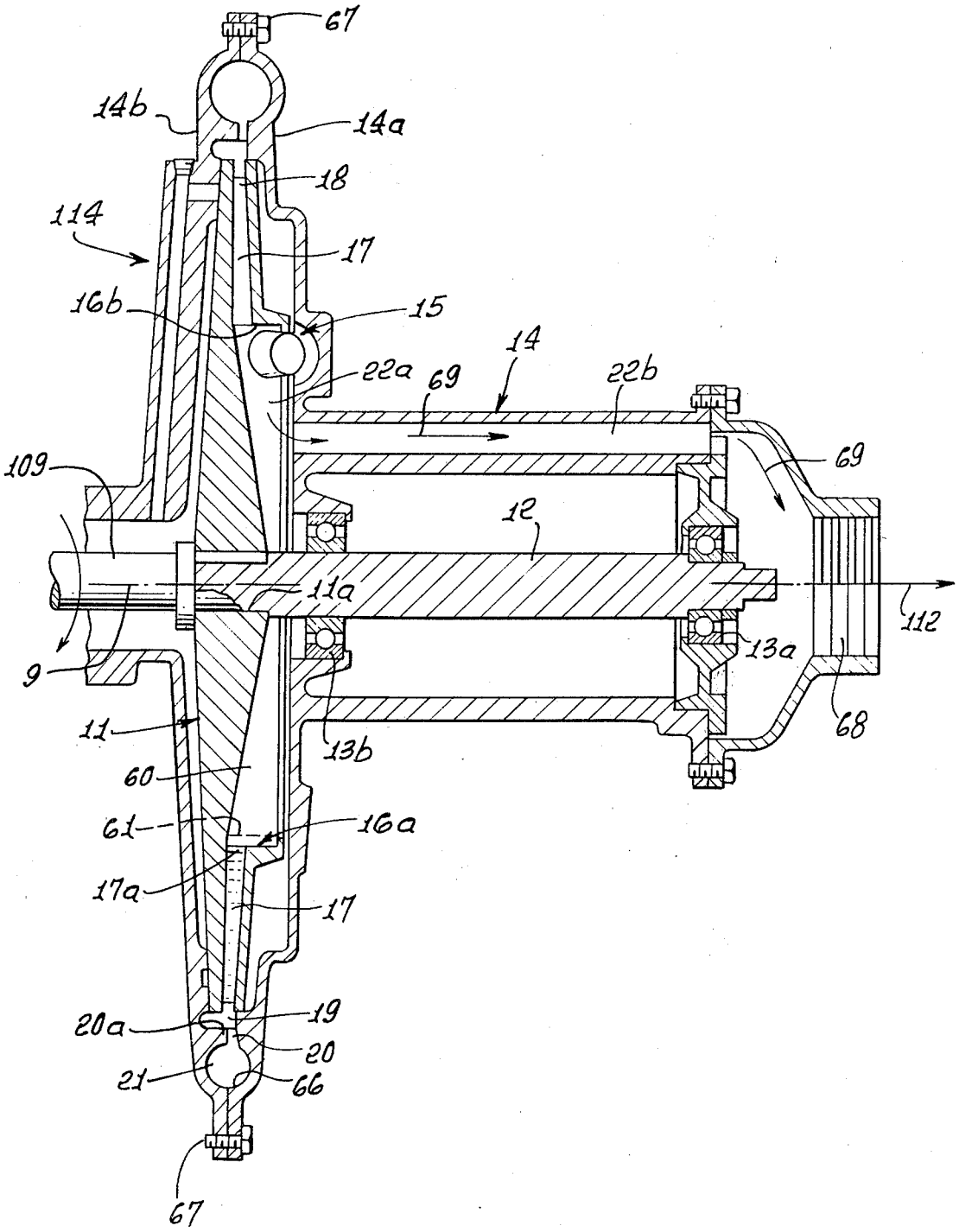
FIG. 1 is a vertical section through a two-phase reaction turbine.

Referring now to FIG. 1, the single stage two-phase reaction turbine 114 shown includes rotor 11 mounted at 11*a* on shaft 12 which may be suitably coupled to shaft 109 referred to above. The shaft 12 is supported by bearings 13*a* and 13*b*, which are in turn supported by housing 14. The two-phase nozzle 15, also carried by housing 14, is oriented to discharge the two-phase working fluid such as saturated refrigerant liquid at elevated pressure into the annular area 16*a* of rotary separator 11 wherein refrigerant liquid and refrigerant vapor are separated by virtue of the centrifugal force field of the rotating element 11. In this regard, the element 11 has an axis 9 and defines an annular, rotating rim or surface 16*b* located in the path of the nozzle discharge for supporting a layer of separated liquid on that surface. The separated vapor collects in zone 60 spaced radially inwardly of inwardly facing shoulder or surface 16*b*. The nozzle itself may have a construction as described in U.S. Pat. Nos. 3,879,949 or 3,972,195. The surface of the layer of liquid at zone 16*a* is indicated by broken line 61, in FIG. 1. The source of the saturated refrigerant liquid fed to the nozzles is indicated at 65 in FIG. 2, and typically includes the compressor 110 and condenser 112 referred to.

Figure 3:
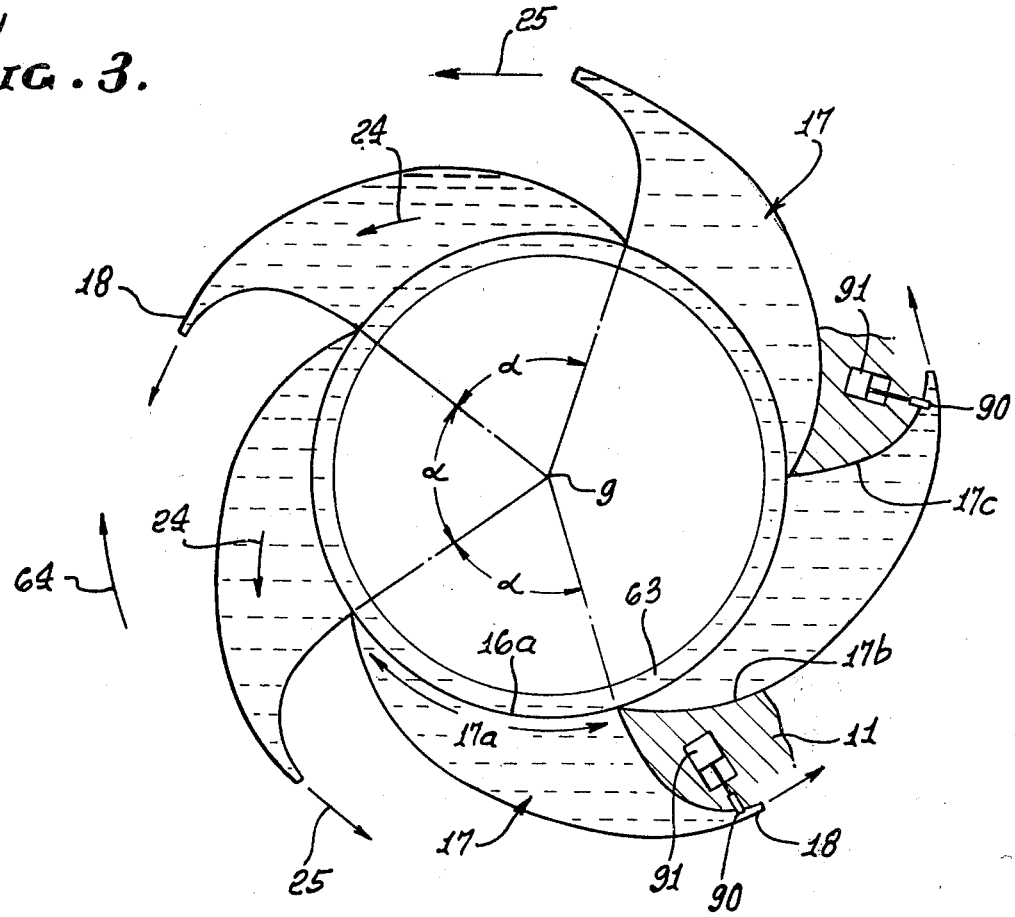
FIG. 3 is an axial schematic view of the rotor contour.

The rotor 11 has reaction nozzle means located to communicate with the separated liquid collecting in area 16*a* to receive such liquid for discharge in a direction or directions to develop torque acting to rotate the rotor. More specifically, the rotor 11 may contain multiple passages 17 spaced about axis 9 to define enlarged entrances 17*a* communicating with the surface or rim 16*b* and the liquid separating thereon in a layer to receive liquid from that layer. FIG. 3 schematically shows such entrances 17*a* adjacent annular liquid layer 63 built up on rim or surface 16*a*. The illustrated entrances subtend equal angles $\alpha$ about axis 9, and five such entrances are shown, although more or less than five entrances may be provided. Arrow 64 shows the direction of rotation of the rotor, with the reaction nozzles 18 (one associated with each passage) each angularly offset in a trailing direction from its associated passage entrance 17*a*. Passages 17 taper from their entrances 17*a* toward the nozzles 18 which extend generally tangentially (i.e. normal to radii extending from axis 9 to the nozzles). Note tapered walls 17*b* and 17*c* in FIG. 3, such walls also being curved.

The nozzles 18 constitute the reaction stage of the turbine. The liquid discharged by the nozzles is collected in annular collection channel 19 located (see FIG. 2) directly inwardly of diffuser ring 20*a* defining diffuser passages 20. The latter communicate between passage 19 and liquid volute 21 formed between ring 20*a* and housing walls 66. The housing may include two sections 14*a* and 14*b* that are bolted together at 67, to enclose the wheel or rotor 11, and also form the diffuser ring, as is clear from FIG. 1. FIG. 1 also shows passages 22*a* and 22*b* formed by the housing or auxiliary structure to conduct separated vapor to discharge duct 68, as indicated by flow arrows 69.

Figure 2:
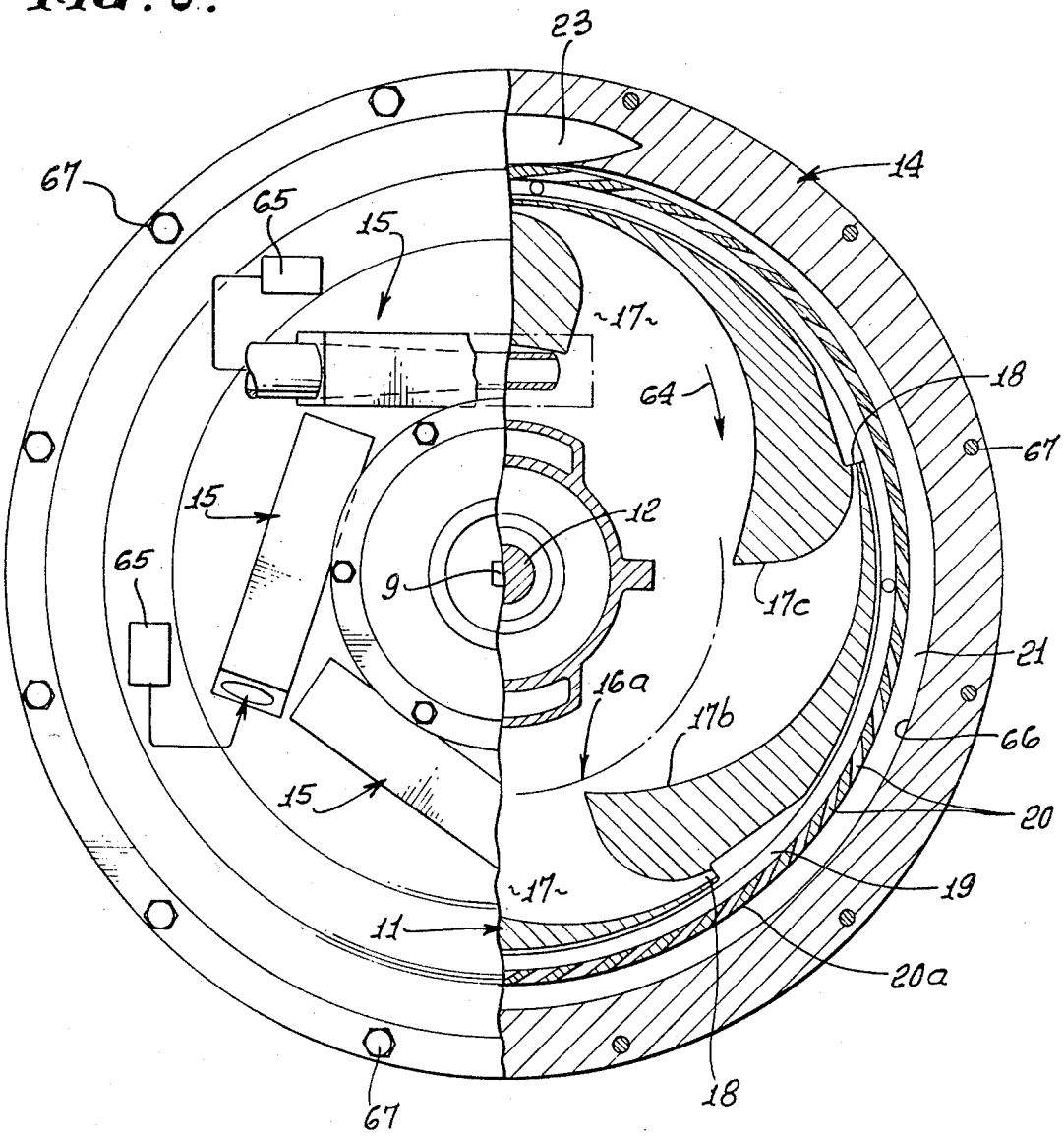
FIG. 2 is an axial view of the FIG. 1 apparatus.

The rotor passages 17 which provide pressure head to the reaction nozzles 18 are depicted in FIG. 2 as spaced about axis 9. Nozzles 15 are shown in relation to the rotary separator area 16*a*. It is clear that droplets of liquid issuing from the nozzles impinge on the rotary separator area 16*a*, where the droplets merge into the liquid surface and in so doing convert their kinetic energy to mechanical torque. One nozzle 15, or a multiplicity of nozzles, may be employed depending on desired capacity. The endwise shape or tapering of the liquid discharge volute 21 is easily seen in FIG. 2; liquid discharge takes place at the volute exit 23.

The flow path for the liquid in the rotor of the turbine is shown in FIG. 3 to further clarify the reaction principle. Liquid droplets from the nozzle impinge on the liquid surface 16*a*, and the liquid flows radially outward in the converging passages 17 to the liquid reaction nozzles 18. The reaction nozzles 18 are oriented in tangential directions adding torque to the rotating element. Liquid flow within each passage 17 is in the direction of the arrow 24. Jets of liquid issuing from the reaction nozzles 18 are in the tangential directions shown by the arrows 25. Note that the static pressure in spaces 60 and 19, in FIG. 1, is the same; outwardly of the rotor there is no reaction pressure drop. Such drop is inside the nozzles 18 to space 19, outside of nozzles 18.

FIG. 3 also shows the provision of one form of means for selectively closing off liquid flow from the nozzles to vary the power output from the rotor. As schematically shown, such means includes gates or plugs 90 movable by drivers 91 into different positions in the passages 17 to variably restrict flow therein.

The turbine shown in FIG. 5*a* is generally like that of FIGS. 1–3, with one exception. It includes vapor compression vanes 70 on rotor 11, and a vapor collecting volute 71 outwardly of those vanes. Thus, vapor separating from the liquid separating at 16*a* flows at 72 toward and between the vanes for compression and discharge to volute 71 as the rotor rotates. Arrow 74 indicates discharge of compressed vapor from that volute, and supply to line or path 142, in FIG. 5. Note that the housing wall 176 approaches the shaft 12 at 175 to block off vapor escape.

Useful refrigerants in the FIGS. 4 and 5 system include propylene and ethylene.

The use of the above described turbine provides an expansion step which produces more liquid, and less vapor, than expansion through a throttling valve. The increased amount of liquid at each expansion step improves the efficiency of the refrigeration system. For a typical olefin plant, design calculation shows that input power reduction, in percent is realized as follows, for vapor compression:

| POWER REDUCTION IN PERCENT Constant Refrigeration | | | |
|---|---|---|---|
| | Process | | |
| Fluid | Electric Brake | Electricity Utilized | Compressor Added to Turbine |
| Propylene | 2.97 | 7.08 | 4.85 |
| Ethylene | 2.53 | 5.66 | 4.94 |

For an electric brake on the turbine, the reduction is approximately 3% for three propylene stages and 2½% for three ethylene stages. If the electricity generated is returned to the system, as for example to drive the compressor, then the power reductions are 7% and 5.7%, respectively. Finally, power absorption by vapor compression stages on the turbine can reduce power required by approximately 5% for each fluid. If the refrigeration capacity of the plant is required to be increased (for the same plant compressor power) then the latter method increases plant capacity by a like 5% amount. The two electric generating cases increase capacity by 3 and 2½%, respectively, the utilization case also resulting in power saving.

Referring to FIG. 6, the thermodynamic process depends upon expansion following the two-phase path 3–5, which produces more liquid refrigerant than the usual isenthalpic, or Joule-Thompson, throttling 3–6. The approach of the cycle 3–5 to the isentropic 3–4 is measured by the refrigeration efficiency $\eta_e$.

Typical design parameters including efficiencies for refrigeration systems employing three turbine stages, and using propylene and ethylene refrigerant, are as set forth in the following table:

| | Propylene | | | Ethylene | | |
|---|---|---|---|---|---|---|
| Turbine Number | $P_1$ | $P_2$ | $P_3$ | $E_1$ | $E_2$ | $E_3$ |
| Flow Rate, lb/hr × 1000 | 649.3 | 587.0 | 538.0 | 159.0 | 80.1 | 42.1 |
| Inlet Pressure, psig | 204.0 | 83.0 | 27.6 | 252.0 | 85.6 | 24.8 |
| Effective Efficiency, $\eta_e$ | 76.9 | 74.4 | 68.6 | 77.4 | 72.2 | 66.6 |
| Rotor Diameter, inches | 46.6 | 51.0 | 76.0 | 20.7 | 20.5 | 22.2 |
| rpm | 1590.0 | 2340.0 | 1000.0 | 5820.0 | 4070.0 | 2500.0 |

As seen, the six turbines have rotors ranging from 20.5 to 76.0 inches diameter, and speeds of 1000 to 5820 rpm. Stress levels are moderate, such that aluminum construction is feasible.

In FIG. 7 a heat pump system is shown, and which is similar to any of the stages in the system of FIG. 4. Thus, elements 209–227 shown correspond to elements 109–127 shown in FIG. 4. Element 212 comprises a heat exchanger from which heat is derived or extracted at 230, as by operation of a fan blowing air over coils in the heat exchanger to heat the air (and cool the working fluid). Heat at a low temperature level is absorbed by the expanded working fluid from the surroundings (for example) as by operation of evaporator 222. Any suitable fluid medium may be employed. The heat extracted at 230 may be used for any purpose. The electricity generated at 226 and 227 may be used, in part, to energize the compressor drive.

We claim:

1. In a refrigeration process employing a circulating fluid refrigerant, the process including compressing and cooling the refrigerant, expanding the cooled refrigerant to lower temperature and pressure levels, and then passing the expanded refrigerant through a refrigeration zone wherein heat is absorbed by the refrigerant, the steps that include (a) carrying out said expansion through a first nozzle flow region to produce a liquid and vapor discharge, (b) providing a rotor and collecting the liquid discharge in a ring on the rotor in such manner as to centrifugally pressurize the collected liquid, (c) providing reaction nozzle means to rotate with the rotor and in communication with the ring of collected liquid and controllably passing the collected liquid through said reaction nozzle means to produce torque to rotate the rotor and to maintain said ring, and (d) collecting liquid discharged from said reaction nozzle means for supply to said refrigeration zone.

2. The process of claim 1 including compressing the vapor in response to rotation of the rotor, and returning the compressed vapor to the circulating refrigerant.

3. The process of claim 1 including also subjecting liquid discharged from the reaction nozzle means to additional steps (a)', (b)', (c)' and (d)' respectively corresponding to steps (a), (b), (c) and (d).

4. The method of claim 1 including controlling the rate of rotation of the rotor to maintain a ring of said liquid collected on the rotor.

5. The method of claim 1 wherein said (c) step includes controllably adjusting the size of the flow path through said reaction nozzle means.

6. The method of claim 1 including causing vanes on the rotor to compress the vapor discharge, and conducting said compressed vapor from the rotor.

7. The method of claim 6 including recirculating the compressed vapor to the process to be compressed and cooled as aforesaid.

8. The method of claim 1 including converting the energy of rotor rotation into electrical power.

9. In a heat pump process employing a circulating fluid, the process including compressing and cooling the fluid to provide heat, expanding the cooled fluid to lower temperature and pressure levels, and then passing the expanding fuid through a zone wherein heat is absorbed by the expanded fluid, the steps that include:

(a) carrying out said expansion through a first nozzle flow region to produce a liquid and vapor discharge, (b) providing a rotor and collecting the liquid discharge in a ring on the rotor in such manner as to centrifugally pressurize the collected liquid, (c) providing reaction nozzle means in association with the rotor and in communication with the ring of collected liquid and controllably passing the collected liquid through said rection nozzle means to produce torque to rotate the rotor and to maintain said ring, and (d) collecting liquid discharged from said reaction nozzle means for supply to said zone.

10. In a process wherein a fluid stream is supplied at elevated pressure, the process including expanding the fluid to a lower pressure level, the steps that include (a) carrying out said expansion through a first nozzle flow region to produce a liquid and gas discharge, (b) providing a rotor and collecting the liquid discharge in a ring on the rotor in such manner as to centrifugally pressurized the collected liquid, (c) providing reaction nozzle means in association with the rotor and in communication with the ring of collected liquid and controllably passing the collected centrifugally pressurized liquid through said reaction nozzle means to produce torque to rotate the rotor and to maintain said ring.

11. In a process wherein a fluid stream is supplied at elevated pressure, the process including expanding the fluid to a lower pressure level, the steps that include (a) carrying out said expansion through a first nozzle flow region to produce a liquid and gas discharge, (b) providing a rotor and collecting the liquid discharge in a ring on the rotor in such manner as to centrifugally pressurized the collected liquid, (c) controllably removing liquid from the ring on the rotor so as to maintain said ring, with the rotor rotating, and (d) converting the energy of rotor rotation into usable power.

12. The process of claim 11 including returning to the process the liquid removed from said ring for repressurization to said elevated pressure.

13. The method of claim 11 including converting energy of rotor rotation into electrical power.

14. The method of claim 11 including causing vanes on the rotor to compress the gaseous discharge, and conducting said compressed gas from the rotor.

15. The method of claim 11 including conducting the gaseous discharge to a region generally radially outwardly of the rotor, and causing vanes on the rotor to compress the gas during said conducting so as to pressurized the gas in said region.

16. The method of claim 15 including returning the pressurized gas to the process fluid stream at a point prior to said expansion of the stream.

* * * * *

UNITED STATES PATENT AND TRADEMARK OFFICE

CERTIFICATE OF CORRECTION

PATENT NO. : 4,336,693

DATED : June 29, 1982

INVENTOR(S) : Lance G. Hays, Walter R. Studhalter
Emil W. Ritzi

It is certified that error appears in the above-identified patent and that said Letters Patent are hereby corrected as shown below:

On the title page, /75/ Inventors: should read:

--Lance G. Hays, Los Angeles, Walter R. Studhalter, Woodland Hills; Emil W. Ritzi, Manhattan Beach; William E. Amend, Rolling Hills Estates; Norman L. Helgeson, Pasadena, all of California--

Signed and Sealed this

*Twenty-sixth* Day of *July 1983*.

[SEAL]

*Attest:*

GERALD J. MOSSINGHOFF

*Attesting Officer*

*Commissioner of Patents and Trademarks*